US010876546B2

(12) United States Patent
Okada et al.

(10) Patent No.: US 10,876,546 B2
(45) Date of Patent: Dec. 29, 2020

(54) CENTRIFUGAL COMPRESSOR

(71) Applicant: MITSUBISHI HEAVY INDUSTRIES COMPRESSOR CORPORATION, Tokyo (JP)

(72) Inventors: Noriyuki Okada, Tokyo (JP); Eiichi Yanagisawa, Tokyo (JP); Kazutoshi Yoko, Tokyo (JP); Yuji Masuda, Hiroshima (JP); Shinichiro Tokuyama, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 217 days.

(21) Appl. No.: 16/087,427

(22) PCT Filed: Mar. 6, 2017

(86) PCT No.: PCT/JP2017/008846
§ 371 (c)(1),
(2) Date: Sep. 21, 2018

(87) PCT Pub. No.: WO2017/169542
PCT Pub. Date: Oct. 5, 2017

(65) Prior Publication Data

US 2019/0101133 A1 Apr. 4, 2019

(30) Foreign Application Priority Data

Mar. 28, 2016 (JP) ..... 2016-063016

(51) Int. Cl.
*F04D 29/58* (2006.01)
*F04D 29/46* (2006.01)
(Continued)

(52) U.S. Cl.
CPC ..... *F04D 29/5853* (2013.01); *F04D 17/12* (2013.01); *F04D 17/122* (2013.01);
(Continued)

(58) Field of Classification Search
CPC .... F04D 17/22; F04D 17/125; F04D 29/5853; F04D 17/12; F04D 17/122; F04D 29/284;
(Continued)

(56) References Cited

U.S. PATENT DOCUMENTS 3,874,814 A 4/1975 Carroll et al.
4,531,356 A * 7/1985 Linder ..... F02C 7/045 415/119

(Continued)

FOREIGN PATENT DOCUMENTS

EP 1933038 A1 6/2008
JP S48-18811 A 3/1973

(Continued)

OTHER PUBLICATIONS

Notice of Reasons for Refusal issued in corresponding Japanese Patent Application No. 2016-063016, dated Jul. 23, 2019 (8 pages).

(Continued)

*Primary Examiner* — Michael Lebentritt
*Assistant Examiner* — Eric J Zamora Alvarez
(74) *Attorney, Agent, or Firm* — Osha Bergman Watanabe & Burton LLP

(57) ABSTRACT

A centrifugal compressor that includes a rotor including a shaft rotatably supported in a casing and an impeller secured to an outer periphery of the shaft; a diaphragm surrounding the impeller from an outer peripheral side; a suction side casing head disposed so as to be spaced apart from the diaphragm on a side where a fluid is suctioned; a temperature adjusting mechanism that is provided in the suction side casing head and configured to adjust a temperature of
(Continued)

environment by flow of a heat medium; a heat shield that is provided between the suction side casing head and the diaphragm and defines, together with the impeller, a suction flow path through which the fluid is introduced to the impeller; and a plurality of straightening vanes that are provided in the suction flow path and configured to straighten the fluid flowing through the suction flow path.

20 Claims, 7 Drawing Sheets

(51) Int. Cl.

| | |
|---|---|
| ***F04D 17/12*** | (2006.01) |
| ***F04D 29/62*** | (2006.01) |
| ***F04D 29/42*** | (2006.01) |
| ***F04D 29/44*** | (2006.01) |
| ***F04D 29/28*** | (2006.01) |
| ***F04D 29/30*** | (2006.01) |

(52) U.S. Cl.
CPC ..... *F04D 29/284* (2013.01); *F04D 29/30* (2013.01); *F04D 29/4213* (2013.01); *F04D 29/441* (2013.01); *F04D 29/46* (2013.01); *F04D 29/462* (2013.01); *F04D 29/58* (2013.01); *F04D 29/584* (2013.01); *F04D 29/624* (2013.01); *F04D 29/444* (2013.01)

(58) Field of Classification Search
CPC .... F04D 29/30; F04D 29/4213; F04D 29/441; F04D 29/46; F04D 29/462; F04D 29/58; F04D 29/584; F04D 29/624; F04D 29/444
See application file for complete search history.

(56) References Cited

U.S. PATENT DOCUMENTS

| | | | | |
|---|---|---|---|---|
| 2013/0058769 | A1 | 3/2013 | Sassanelli et al. | |
| 2015/0016977 | A1 | 1/2015 | Muranyi et al. | |
| 2015/0330407 | A1* | 11/2015 | Klett | F04D 29/584 415/48 |
| 2015/0377252 | A1* | 12/2015 | Sezal | F04D 17/08 415/159 |

FOREIGN PATENT DOCUMENTS

| | | | |
|---|---|---|---|
| JP | S54-055505 | U | 4/1979 |
| JP | H8-312590 | A | 11/1996 |
| JP | 2013-513064 | A | 4/2013 |
| JP | 2016-003584 | A | 1/2016 |

OTHER PUBLICATIONS

English Translation of International Preliminary Report on Patentabilty for corresponding International Application No. PCT/JP2017/008846, dated Oct. 11, 2018 (9 pages).
European Search Report in corresponding European Patent Application No. 17774087.5, dated Feb. 27, 2019 (8 pages).

* cited by examiner

CENTRIFUGAL COMPRESSOR

TECHNICAL FIELD

The present invention relates to a centrifugal compressor configured to compress a fluid using an impeller.

BACKGROUND ART

Centrifugal compressors used in industrial processes and process plants radially pass a fluid such as air or gas through a rotating impeller, and compress the fluid using a centrifugal force generated in passing the fluid. The centrifugal compressor includes, as a basic configuration, a casing and a rotor housed in the casing. The rotor includes a shaft rotatably supported in the casing, and a plurality of impellers secured to an outer peripheral surface of the shaft.

The centrifugal compressors can be divided into a single stage type compressor including a single impeller, and a multistage type compressor including a plurality of impellers arranged in series in a direction of a rotation axis, and the latter multistage type centrifugal compressor is often used.

A known object to be compressed by the centrifugal compressor is boil off gas (BOG), for example, as described in Patent Literature 1. For example, a boil off gas of a liquefied natural gas (LNG) is a fluid of extremely low temperature. In this centrifugal compressor, particularly at the beginning of an operation, a vicinity of a gas suction flow path is exposed in extremely low temperature, while an outer peripheral surface of the compressor is exposed to atmospheric temperature, which causes a large temperature difference. Then, thermal stress due to contraction of components occurs the vicinity of the suction flow path. In order to reduce the temperature difference between the inside and outside of the centrifugal compressor, Patent Literature 1 proposes heating the vicinity of the suction flow path using oil as a heat medium.

CITATION LIST

Patent Literature

Patent Literature 1: JP 2013-513064 W

SUMMARY OF INVENTION

Technical Problem

However, reducing the temperature difference between the inside and outside of the centrifugal compressor only by heating with oil requires a large amount of oil, and cost increase caused by ancillary facilities and devices for that purpose becomes unignorable.

On the other hand, a casing that forms a shell of the centrifugal compressor and internal components provided in the casing have different thermal responses based on a difference in heat capacity from each other. Thus, a difference in thermal deformation (or thermal expansion) needs to be considered between a period from start to steady operation and a period from the steady operation to stop, with respect to the centrifugal compressor.

From the above, the present invention has an object to provide a centrifugal compressor capable of reducing thermal contraction in a vicinity of a gas suction flow path at the beginning of an operation using a small amount of heat medium, and also accommodating thermal deformation that occurs during processes in its operation.

Solution to Problem

A centrifugal compressor of the present invention includes: a rotor including a shaft rotatably supported in a casing and an impeller secured to an outer periphery of the shaft; a diaphragm surrounding the impeller from an outer peripheral side; a suction side casing head disposed so as to be spaced apart from the diaphragm on side where a fluid is suctioned; a temperature adjusting mechanism that is provided in the suction side casing head and configured to adjust a temperature of environment by flow of a heat medium; a heat shield that is provided between the suction side casing head and the diaphragm and defines, together with the impeller, a suction flow path through which the fluid is introduced to the impeller; and a plurality of straightening vanes that are provided in the suction flow path and configured to straighten the fluid flowing through the suction flow path, wherein even if the straightening vanes are displaced in a direction away from the heat shield, an interference state between the straightening vanes and the heat shield is maintained.

In the centrifugal compressor of the present invention, the shield that defines the suction flow path is provided. Thereby, it is possible to reduce thermal contraction in the vicinity of the gas suction flow path at the beginning of an operation.

In a centrifugal type compressor, a casing and internal components provided in the casing have different thermal responses based on a difference in heat capacity from each other. Thus, a space between a heat shield and straightening vanes tends to be large in a period between start and steady operation of the centrifugal type compressor and small in a period between the steady operation and stop of the centrifugal type compressor. However, in the centrifugal compressor of the present invention, even if the straightening vanes are displaced in the direction away from the heat shield, the interference state between the straightening vanes and the heat shield can be maintained. This can prevent a gap from being created between the straightening vanes and the shield throughout processes of its operation from start to steady operation and further up to stop.

In the present invention, the plurality of straightening vanes may be secured to the diaphragm. In this case, the heat shield may include an interference maintaining groove in which top end sides of the straightening vanes move in a reciprocating manner in the diaphragm.

Thus, the top end sides of the straightening vanes can move in a reciprocating manner in the interference maintaining groove, that is, the interference state in which the straightening vanes are inserted into the interference maintaining groove can be maintained. This can prevent a gap from being created between the heat shield and the straightening vanes, thereby preventing a reduction in straightening effect of the straightening vanes due to creation of the gap.

Such an interference maintaining mechanism is suitable for a case of using a heat shield that should not be loaded due to its low rigidity.

In the present invention, the plurality of straightening vanes may be integrally formed with the diaphragm. In this case, the heat shield may include a plurality of interference maintaining grooves in which top end sides of the plurality of straightening vanes move in a reciprocating manner respectively.

As such, when the interference maintaining grooves corresponding to the straightening vanes are provided respectively, it is possible to reduce a gap between the respective straightening vanes and the diaphragm, thereby preventing a reduction in the straightening effect of the straightening vanes due to the gap. In particular, when the top end sides of the straightening vanes are inserted into the interference maintaining grooves without any substantial gap respectively, it is possible to prevent or minimize the reduction in the straightening effect of the straightening vanes.

As another means for using an interference maintaining groove, the plurality of straightening vanes may include a sealing body having an annular shape and removably secured to the diaphragm and circumferentially connecting top ends of the plurality of straightening vanes. Such an interference maintaining mechanism is characterized in that the heat shield includes an interference maintaining groove having an annular shape in which the sealing body moves in a reciprocating manner.

In this interference maintaining mechanism, the sealing body can move in a reciprocating manner in the interference maintaining groove having an annular shape, thereby allowing a state in which the straightening vanes are inserted into the interference maintaining groove to be maintained. This can prevent a gap from being created between the heat shield and the straightening vanes, thereby preventing a reduction in straightening effect of the straightening vane due to creation of the gap. Also in this case, when the sealing body is inserted into the interference maintaining groove without any substantial gap, it is possible to prevent or minimize the reduction in straightening effect of the straightening vanes.

As an interference maintaining mechanism of the present invention, the plurality of straightening vanes may be secured to the heat shield via a seal material that seals between the straightening vanes and the heat shield. Even if the straightening vanes are displaced in a direction away from the heat shield, the seal material provided between the straightening vanes and the heat shield can contract. Thereby, it is possible to prevent a gap from being substantially created and maintain an interference state.

In the present invention, a heat insulating space is preferably provided between the suction side casing head and the heat shield. This can keep heat transfer low from a fluid as an object to be compressed to the suction side casing head.

In the present invention, it is preferable that when the heat shield has an annular shape including an outer diameter side and an inner diameter side in a plan view, the outer diameter side is secured to a first casing and the inner diameter side is a free end.

In the present invention, it is preferable that the plurality of straightening vanes include concave surfaces and convex surfaces facing the concave surfaces, and the plurality of straightening vanes are arranged symmetrically with respect to the fluid flowing through the suction flow path, and the concave surfaces are arranged to face a flow direction of the fluid.

Advantageous Effects of Invention

According to the centrifugal compressor of the present invention, the shield that defines the suction flow path is provided, thereby possible to reduce thermal contraction a vicinity of the gas suction flow path at the beginning of the operation. Further, according to the centrifugal compressor of the present invention, the interference between the straightening vanes and the shield can prevent a gap from being created between the straightening vanes and the shield throughout processes from start to steady operation and further up to stop.

DESCRIPTION OF EMBODIMENTS

First Embodiment

Now, with reference to the accompanying drawings, embodiments of the present invention will be described.

In this embodiment, a multistage type centrifugal compressor including a plurality of impellers will be described as an example of a centrifugal compressor.

Figure 1:
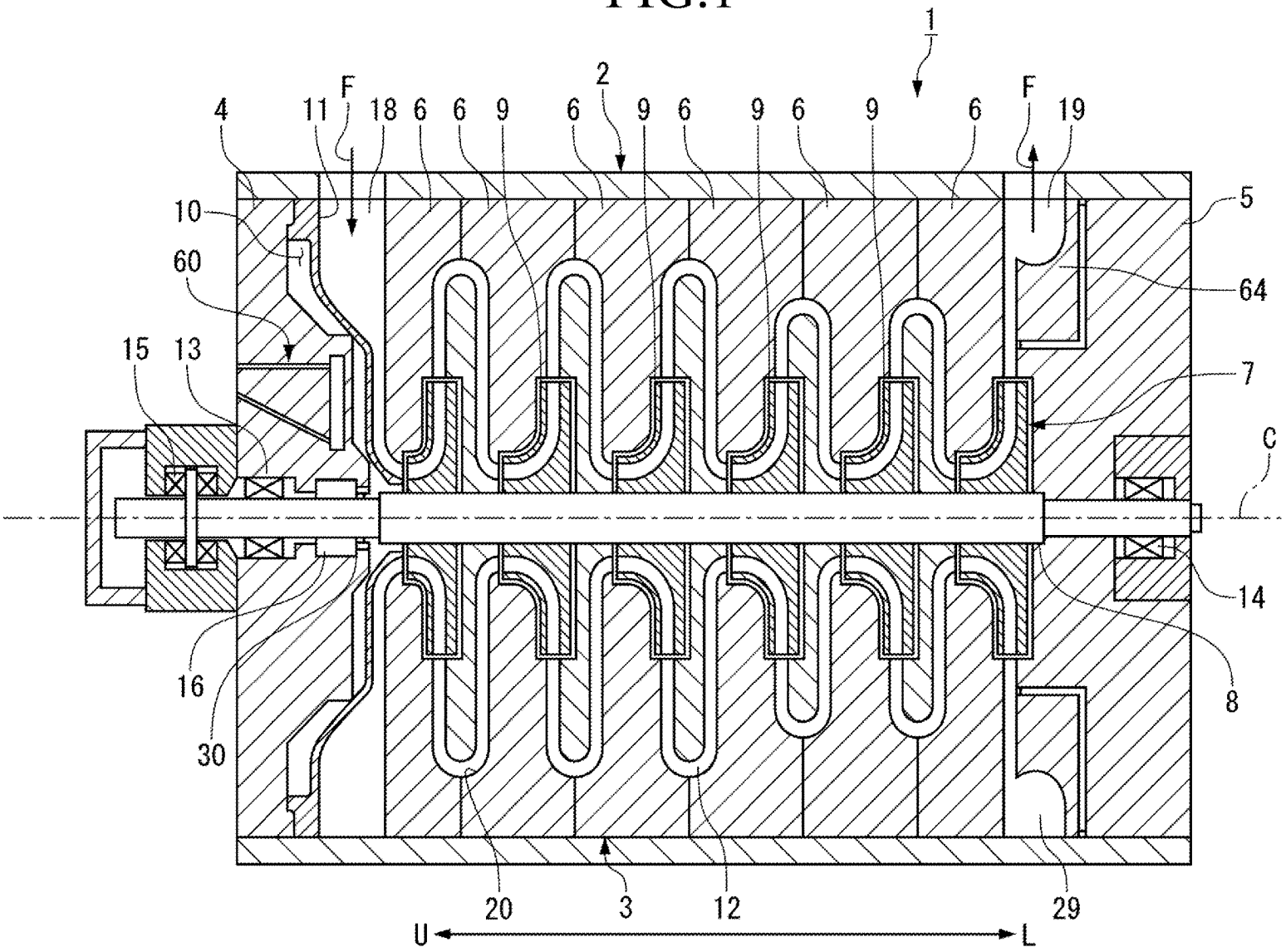
FIG. 1 is a sectional view of a schematic configuration of a centrifugal compressor according to a first embodiment of the present invention.

As shown in FIG. 1, the centrifugal compressor 1 of this embodiment includes a casing 2 that forms a shell of the centrifugal compressor 1, and a rotor 7 rotatably supported in the casing 2. The rotor 7 includes a shaft 8 extending along an axis C, and a plurality of impellers 9 secured to an outer peripheral surface of the shaft 8. The centrifugal compressor 1 is used to compress a boil off gas (fluid F) of an LNG of extremely low temperature, and includes an oil heater 60 to reduce a temperature difference between the inside and outside of a suction side casing head 4 particularly at the beginning of an operation.

In the centrifugal compressor 1, an extending direction of the axis C of the shaft 8 is referred to as an axis direction, and a direction perpendicular to the axis C is referred to as a radial direction. In the centrifugal compressor 1, as shown in FIG. 1, an upstream side U and a downstream side L are specified with reference to a flow direction of the fluid F as an object to be compressed. The upstream side U and the downstream side L are relative to each other.

As shown in FIG. 1, in the casing 2, a diaphragm 3 surrounding the impellers 9 from an outer peripheral side, the suction side casing head 4 spaced apart from the diaphragm 3 on the most upstream side U in the axis direction, a discharge side casing head 5 spaced apart from the diaphragm 3 on the most downstream side L in the axis direction, and a heat shield 11 secured to the suction side casing head 4 are provided.

The diaphragm 3 in this embodiment has a configuration in which a plurality of diaphragm pieces 6 are arranged in the axis direction as an example.

The impellers 9 pump the fluid F flowing from the upstream side U toward the downstream side L radially outward using a centrifugal force generated by the impellers 9 rotating with the shaft 8. For that purpose, a fluid flow path 12 through which the fluid F is made to flow from the upstream side U toward the downstream side L is formed in the casing 2.

As shown in FIG. 1, the casing 2 has a cylindrical shape and the rotor 7 is coaxially placed. In the suction side casing head 4, a first journal bearing 13 is provided as a bearing device that rotatably supports an end of the upstream side U of the shaft 8. Further, on the upstream side U of the first journal bearing 13, a thrust bearing 15 that supports the end of the upstream side U of the shaft is provided. The first journal bearing 13 is secured in the suction side casing head 4, and the thrust bearing 15 is secured to an outside of the suction side casing head 4.

As shown in FIG. 1, a dry gas seal 16 is provided on a radially inner side of the suction side casing head 4. The dry gas seal 16 is provided on the downstream side L of the first journal bearing 13. The dry gas seal 16 is a seal device configured to jet F gas such as a dry gas to airtightly seal around the shaft 8. In addition, a seal fin 30 including a plurality of fins is provided on the downstream side L of the dry gas seal 16. Any seal device capable of sealing a gap between the suction side casing head 4 and the shaft 8 may be adopted, not limited to the dry gas seal 16. For example, a labyrinth seal may be provided as the seal device between the suction side casing head 4 and the shaft 8.

If a large temperature difference suddenly occurs at the beginning of the operation to cause thermal contraction of the suction side casing head 4, a sealed state by the seal device may deteriorate. Then, in this embodiment, the oil heater 60 is provided and also the heat shield 11 is provided to prevent a large temperature difference at the beginning of the operation.

On a radially inner side of the discharge side casing head 5, a second journal bearing 14 that rotatably supports an end of the downstream side L of the shaft 8 is provided. The second journal bearing 14 is secured in the discharge side casing head 5.

As shown in FIG. 1, on an end of the upstream side U of the casing 2, a suction flow path 18 through which the fluid F is introduced from outside is provided. The suction flow path 18 is formed between the heat shield 11 and the diaphragm 3.

On an end of the downstream side L of the casing 2, a discharge flow path 19 through which the fluid F is discharged to the outside is provided. The discharge flow path 19 is formed between a shield member 64 and the diaphragm 3 on a discharge side.

In the casing 2, an internal space 20 is provided so as to communicate with the suction flow path 18 and the discharge flow path 19 and repeat to radially contract and expand. The internal space 20 serves as a space housing the impellers 9, and also as the fluid flow path 12 except for the impellers 9. As such, the suction flow path 18 and the discharge flow path 19 communicate with each other via the impellers 9 and the fluid flow path 12.

Figure 2:
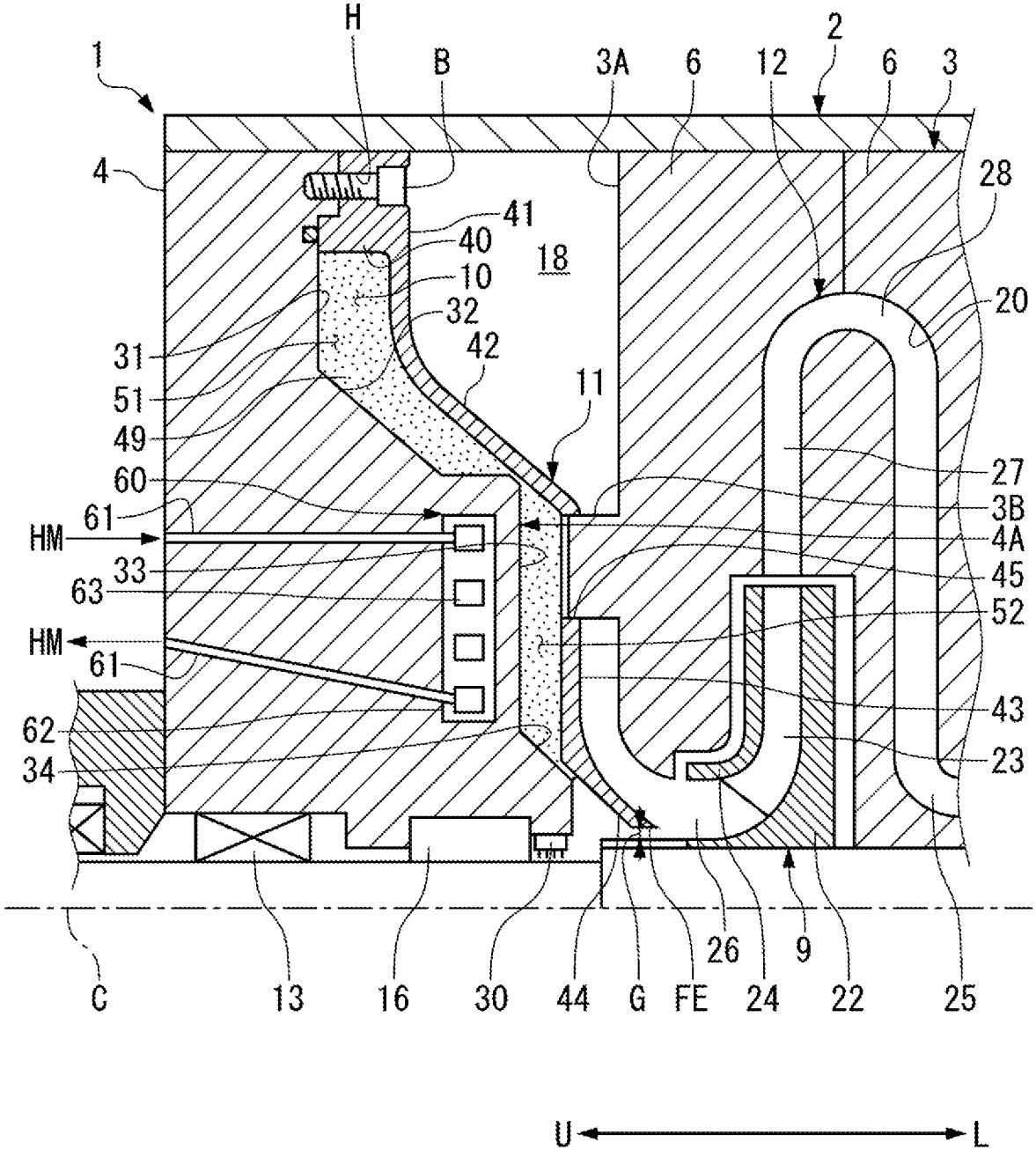
FIG. 2 is a sectional view of a vicinity of suction flow path of the centrifugal compressor in FIG. 1.

As shown in FIG. 1, multiple stages of impellers 9 are arranged at intervals in the axis direction. Although six stages of impellers 9 are provided here as an example, the present invention may be applied to a centrifugal compressor including at least a single stage of impeller 9. As shown in FIG. 2, each impeller 9 includes a substantially disk-like hub 22 having a gradually increasing diameter toward the downstream side L, a plurality of blades 23 radially mounted to the hub 22 and circumferentially arranged, and a shroud 24 mounted to circumferentially cover the top end sides of the plurality of blades 23.

As shown in FIG. 1, the fluid flow path 12 in the casing 2, extends toward the downstream side L while radially meandering, and is formed to connect between adjacent impellers 9, 9. The fluid F is, while flowing through the fluid flow path 12, compressed in a stepwise every time the fluid F passes each stage of the impellers 9. As shown in FIG. 2, the fluid flow path 12 mainly includes a suction passage 25, a compression passage 26, a diffuser passage 27, and a return passage 28.

As shown in FIG. 1, in the casing 2, a discharge scroll 29 for discharging the fluid F is provided.

Next, as shown in FIGS. 1 and 2, the suction side casing head 4 includes the oil heater 60 as a temperature adjusting mechanism configured to heat the suction side casing head 4. The oil heater 60 is provided to adjust temperature of the inside and outside of the centrifugal compressor 1, particularly, reduce a temperature difference between the inside and outside of the centrifugal compressor 1 at the beginning of the operation of the centrifugal compressor 1. The oil heater 60 includes a pipe line 61 formed in the suction side casing head 4, and an oil heater body 62 connected to the pipe line 61, and a heat medium HM is passed through the pipe line 61 to the oil heater body 62.

The pipe line 61 is connected to a supply source of the heat medium HM. The oil heater body 62 has an annular shape and is formed to surround the shaft 8. In the oil heater body 62, a heat medium flow path 63 through which the heat medium HM supplied through the pipe line 61 circulates. For example, a lubricant to be supplied to the first journal bearing 13 and the second journal bearing 14 can be supplied as the heat medium HM to the oil heater 60. Changing a temperature of the heat medium HM makes it possible to change a temperature for heating the suction side casing head 4, or cool the suction side casing head 4 in some cases.

Next, with reference to FIG. 2, a detailed structure of the suction flow path 18 in the centrifugal compressor 1 of this embodiment will be described.

As shown in FIG. 2, the upstream side U of the suction flow path 18 is defined by the heat shield 11 secured to the suction side casing head 4, and the downstream side L of the suction flow path 18 is defined by an end surface 3A of the diaphragm 3. A heat insulating space 10 is formed between the heat shield 11 and the suction side casing head 4.

A head end surface 4A of the suction side casing head 4 facing the downstream side L is a circumferentially extending annular surface. The head end surface 4A includes a first flat portion 31 located on a radially outer side and perpendicular to the axis C, a conical first slope portion 32 located on a radially inner side of the first flat portion 31 and having a decreasing diameter toward the downstream side L, a second flat portion 33 located on a radially inner side of the first slope portion 32 and perpendicular to the axis C, and a conical second slope portion 34 located on a radially inner side of the second flat portion 33 and having a decreasing diameter toward the downstream side L.

The heat shield 11 is a plate-like member having an annular shape in a plan view, and includes an outer diameter side and an inner diameter side. As shown in FIG. 2, the heat shield 11 includes a securing portion 40 located on the outer diameter side, a first disk portion 41 formed on one side of the securing portion 40 with respect to the axis direction, a first conical portion 42 connected to the inner diameter side of the first disk portion 41, a second disk portion 43 connected to a radially inner side of the first conical portion 42, and a second conical portion 44 connected to a radially inner side of the second disk portion 43.

The heat shield 11 is secured to the first flat portion 31 of the suction side casing head 4 via the securing portion 40, and has a cantilever structure in which the heat shield 11 is secured to the first flat portion 31 only by the securing portion 40. Specifically, an inner diameter end of the heat shield 11 is a free end FE, and a gap G is provided between the free end FE of the heat shield 11 and the outer peripheral surface of the shaft 8. Since the inner diameter side of the heat shield 11 is the free end FE, the heat shield 11 thermally expands and contracts in the radial direction without any constraint.

Principal surfaces of the first disk portion 41 and the second disk portion 43 are perpendicular to the axis C respectively. The first conical portion 42 and the second conical portion 44 each have a conical shape having a decreasing diameter toward the downstream side L.

The securing portion 40 is a circumferentially extending annular portion. The securing portion 40 has a plurality of through holes H extending therethrough in the axis direction at predetermined circumferential intervals. FIG. 2 shows a particular vertical section, and shows only one through hole H. The heat shield 11 is removably secured to the first flat portion 31 by fastening a bolt B inserted through the through hole H in a screw hole formed in the first flat portion 31.

As shown in FIG. 2, an annular space that serves as the heat insulating space 10 is formed between the head end surface 4A of the suction side casing head 4 and the heat shield 11.

The heat insulating space 10 is filled without a gap, with a heat insulating material 49 that makes it hard to transfer heat of the heat shield 11 to the suction side casing head 4. However, the heat insulating space 10 is not necessarily filled with the heat insulating material 49.

Figure 3A:
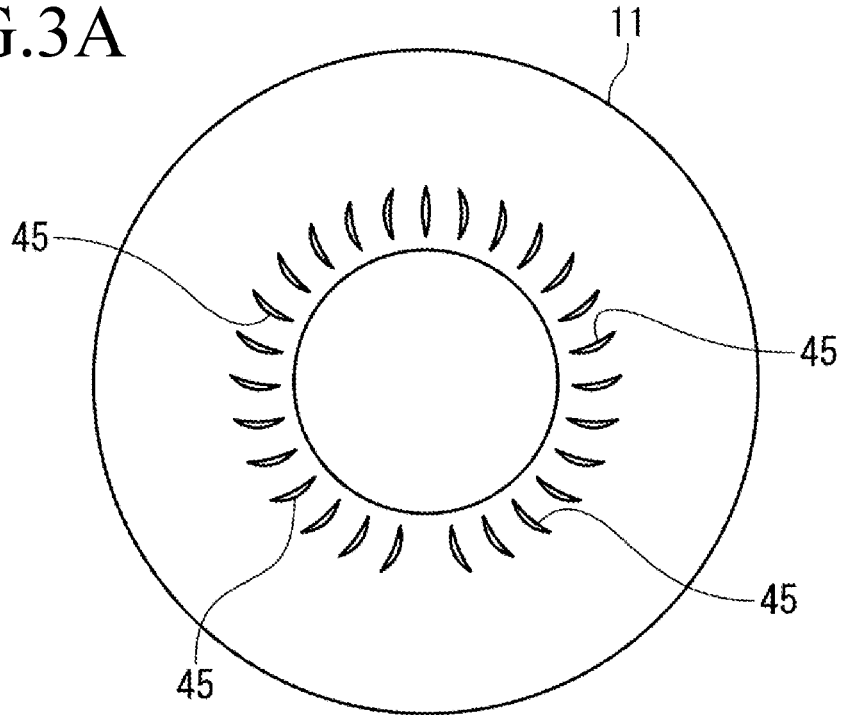
FIG. 3A shows a shield of the centrifugal compressor in FIG. 1 from a downstream side.

As shown in FIGS. 2 and 3, the centrifugal compressor 1 is formed so that the straightening vanes 3B protrude toward the upstream side U from the end surface 3A of the diaphragm 3 provided on the most upstream side U. The straightening vanes 3B straighten a flow of the fluid F sucked from the suction flow path 18 to make the fluid F flow toward the downstream side L. As shown in FIG. 3, in this embodiment, the plurality of straightening vanes 3B are provided at predetermined intervals circumferentially of the end surface 3A. The straightening vanes 3B may be integrally formed with the diaphragm 3, for example, by cutting, or may be fabricated separately from the diaphragm 3 and joined to be secured to the end surface 3A by appropriate means.

Figure 3B:
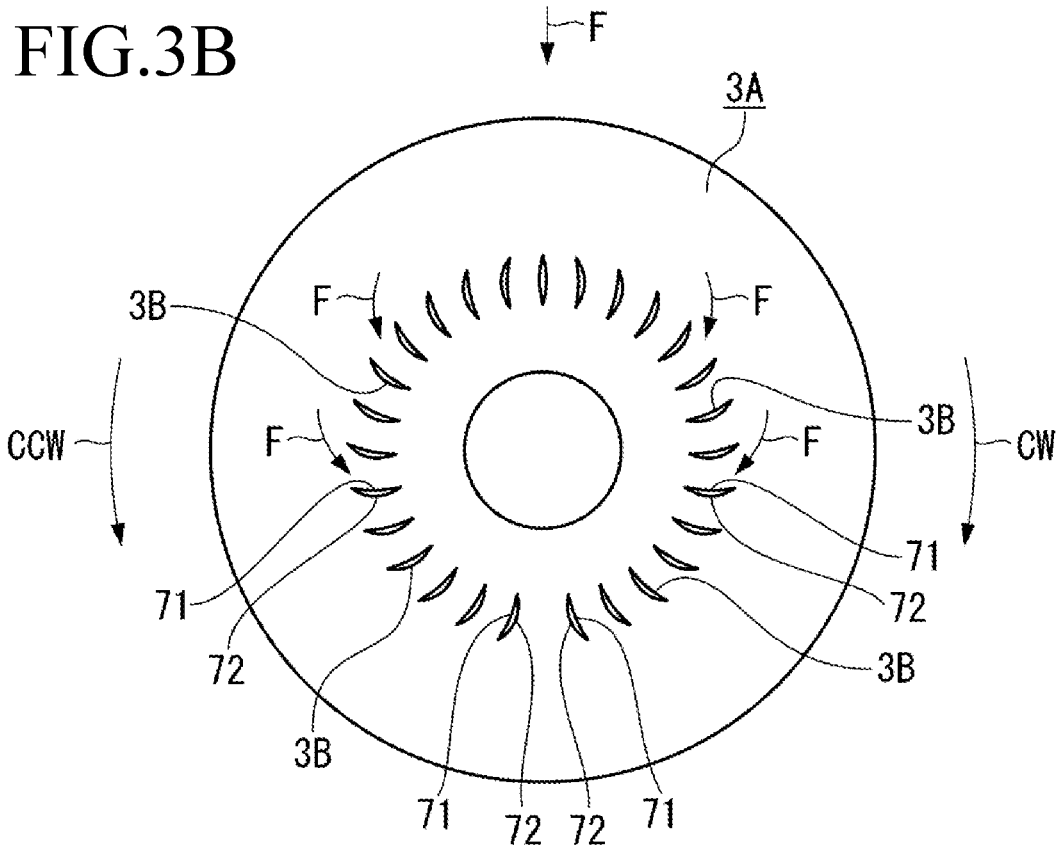
FIG. 3B shows straightening vanes formed on an end surface of a diaphragm of the centrifugal compressor in FIG. 1 from an upstream side.

As shown in FIG. 3B, the plurality of straightening vanes 3B are arranged symmetrically with respect to the fluid F flowing through the suction flow path 18. Specifically, with respect to the plurality of straightening vanes 3B arranged on a right half in FIG. 3B, concave surfaces 71 are directed counterclockwise CCW, and convex surfaces 72 are directed clockwise CW. To the contrary, with respect to the plurality of straightening vanes 3B arranged on a left half in FIG. 3B, concave surfaces 71 are directed clockwise CW, and convex surfaces 72 are directed clockwise CCW. In both the right and left halves, the concave surfaces 71 of the straightening vanes 3B face the flow of the fluid F.

Since the straightening vanes 3B are arranged as described above, the fluid F flowing through the suction flow path 18 is straightened while smoothly flowing between adjacent straightening vanes 3B, 3B in both the right and left halves in FIG. 3B.

As shown in FIGS. 2 and 3, the heat shield 11 in this embodiment has interference maintaining grooves 45 in positions corresponding to the plurality of respective straightening vanes 3B. The plurality of interference maintaining grooves 45 are formed at predetermined intervals circumferentially of the second disk portion 43 so as to penetrate through front and rear surfaces of the second disk portion 43. An opening area of each interference maintaining groove 45 is determined so that the straightening vane 3B is inserted into the interference maintaining groove 45 without any substantial gap and preferably can slide with almost no load. Although an example in which the interference maintaining grooves 45 penetrate through the front and rear surfaces of the second disk portion 43 is shown here, the interference maintaining grooves 45 do not necessarily penetrate through the front and rear surfaces of the heat shield 11 as long as interference between the heat shield 11 and the straightening vanes 3B can be maintained.

As shown in FIG. 2, with respect to the straightening vane 3B and the interference maintaining groove 45, a top end of the straightening vane 3B is inserted into the interference maintaining groove 45. A relationship in which the top end of the straightening vane 3B is inserted into the interference maintaining groove 45 irrespective of an operation state of the centrifugal compressor 1 is always maintained. Specifically, a length of the straightening vane 3B and a depth of the interference maintaining groove 45 are set so that even if the straightening vane 3B is displaced most in a direction X away from the heat shield 11, the top end of the straightening vane 3B stays in the interference maintaining groove 45 in the heat shield 11 as shown in FIG. 4B. As described later, the straightening vane 3B moves in a reciprocating manner in the direction of the axis C in the interference maintaining groove 45, and an insertion depth of the straightening vane 3B into the interference maintaining groove 45 varies.

The centrifugal compressor 1 according to the first embodiment has an advantageous effect as described below.

Since including the oil heater 60, the centrifugal compressor 1 can heat or cool the suction side casing head 4 by selecting the temperature of the heat medium HM supplied. Thus, when the centrifugal compressor 1 compresses the fluid F of extremely low temperature, the heat medium HM of high temperature can be supplied to reduce a temperature difference between the inside and outside of the centrifugal compressor 1, specifically, between the inside and outside of the suction side casing head 4.

Also, in the centrifugal compressor 1, by the heat shield 11 provided between the suction side casing head 4 and the suction flow path 18, it is possible to suppress heat transfer between the suction side casing head 4 and the suction flow path 18. Thus, when the centrifugal compressor 1 compresses the fluid F of extremely low temperature, it is possible to suppress a reduction in temperature of the suction side casing head 4 due to the fluid F, thereby reducing a flow rate of heat medium HM to be supplied to the oil heater 60. Further, the centrifugal compressor 1 includes the heat insulating space 10 between the suction side casing head 4 and the heat shield 11, thereby further reducing heat transfer between the fluid F and the suction side casing head 4.

As described above, the centrifugal compressor 1 includes the oil heater 60 and also includes the heat insulating space 10 and the heat shield 11, thereby reducing a temperature difference between the inside and outside of the centrifugal compressor 1 even when the centrifugal compressor 1 uses, as an object to be compressed, a fluid F having a large temperature difference from an ordinary temperature. This can prevent a defect in the seal device or the like lying a vicinity of the suction flow path 18 of the centrifugal compressor 1 due to thermal deformation that may occur at the beginning of the operation, using a smaller flow rate of heat medium HM.

On the other hand, while the operation of the centrifugal compressor 1 is continued, thermal deformation due to a temperature increase of the centrifugal compressor 1 occurs inevitably. The thermal deformation may cause a gap between the heat shield 11 and the top ends of the straightening vanes 3B, which makes it impossible to sufficiently obtain a straightening effect of the fluid F by the straightening vanes 3B.

Figure 4A:
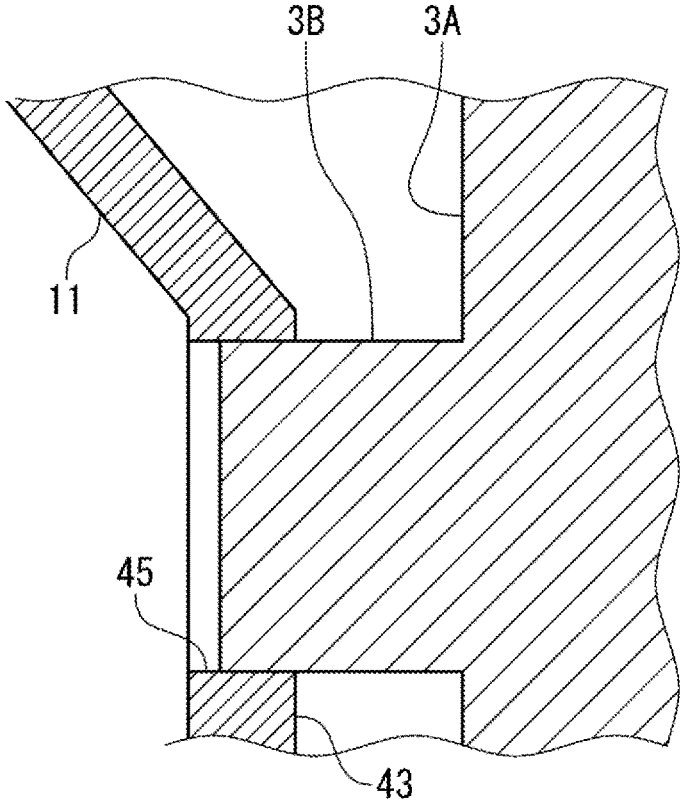
FIG. 4A shows interference between the shield and the straightening vane of the centrifugal compressor in FIG. 1 and shows deformation at the moment of start and deep interference between the shield and the straightening vane.
Figure 4B:
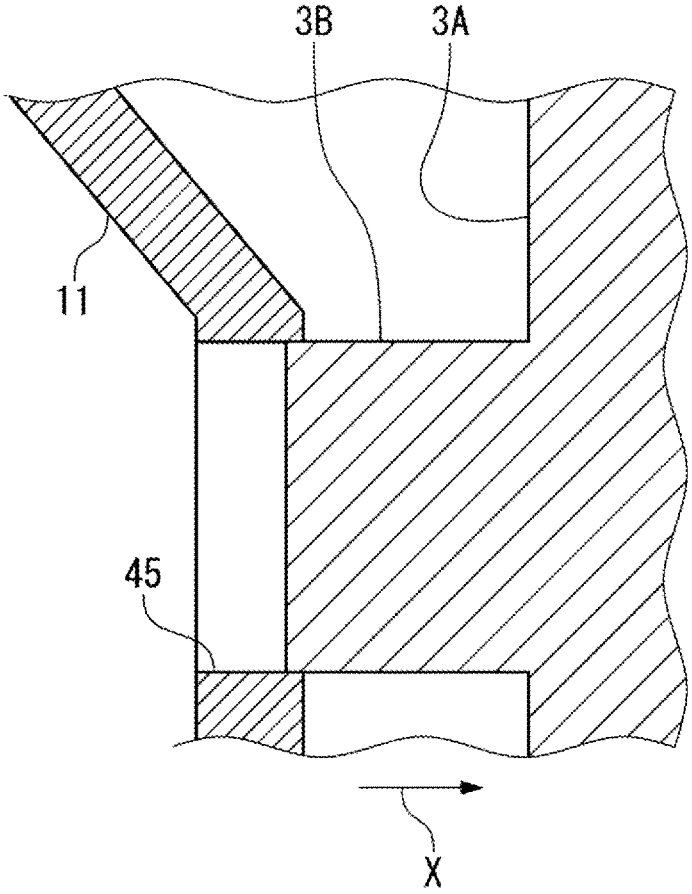
FIG. 4B shows the interference between the shield and the straightening vane of the centrifugal compressor in FIG. 1, and shows deformation at the moment of stop and shallow interference between the shield and the straightening vane.

However, in this embodiment, as shown in FIG. 4A, the top end of the straightening vane 3B is inserted into the interference maintaining groove 45 in the heat shield 11. Even if thermal deformation occurs and the straightening vane 3B is displaced most in the direction away from the heat shield 11, the top end of the straightening vane 3B stays in the interference maintaining groove 45 in the heat shield 11 as shown in FIG. 4B. Thus, since the interference state in which the straightening vanes 3B are inserted into the heat shield 11 is maintained as long as the operation of the centrifugal compressor 1 is continued, the straightening effect of the fluid F by the straightening vanes 3B can be sufficiently obtained, thereby achieving a stable operation.

For making the straightening vanes 3B move in a reciprocating manner with respect to the heat shield 11, not only the above embodiment, but also for example, a variant of this embodiment shown in FIGS. 5 and 6 can be applied. Now, differences from the above example will be mainly described.

Figure 5A:
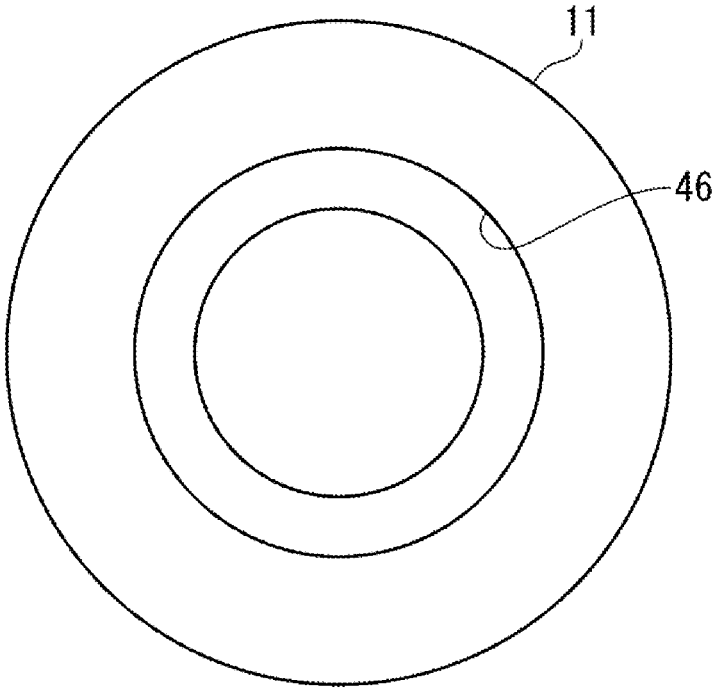
FIG. 5A shows a variant of the first embodiment and shows a shield viewed from a downstream side.
Figure 5B:
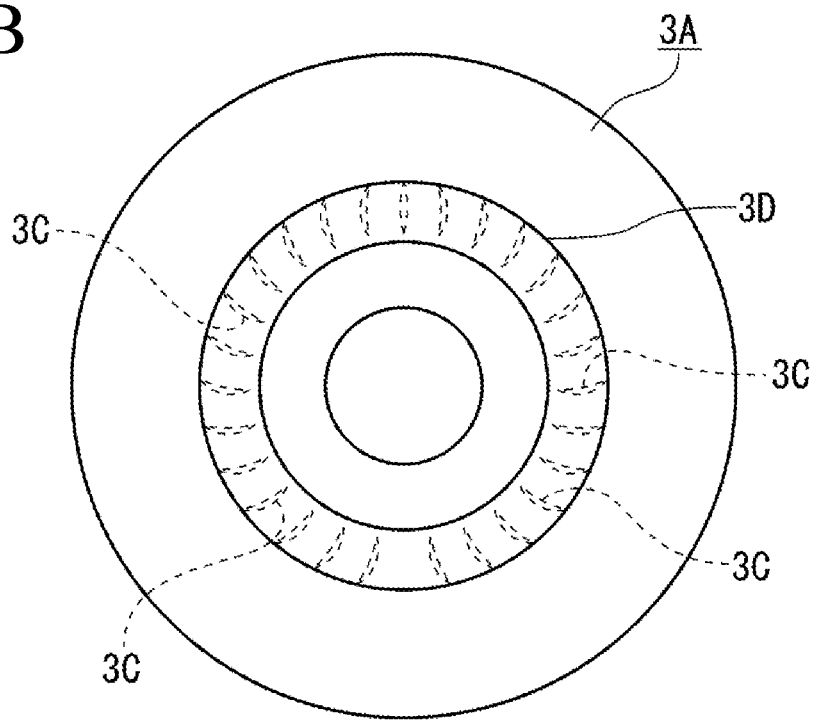
FIG. 5B shows the variant of the first embodiment and shows straightening vanes secured to an end surface 3A of a diaphragm viewed from an upstream side.
Figure 6A:
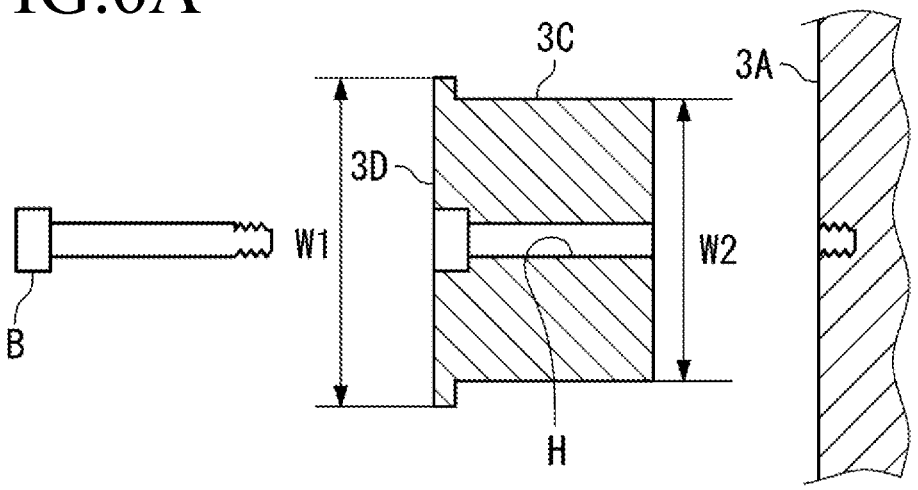
FIG. 6A shows the variant of the first embodiment and shows a configuration thereof.
Figure 6B:
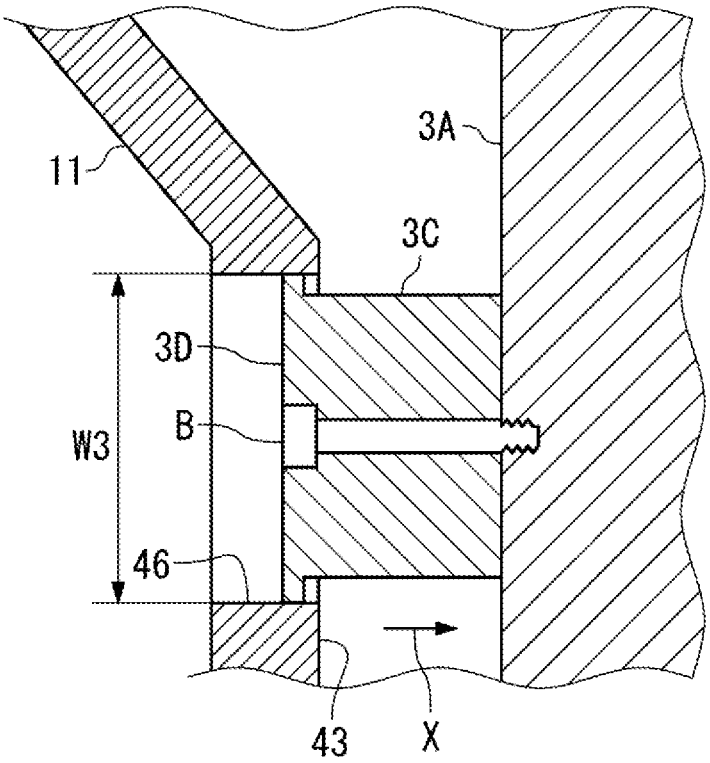
FIG. 6B shows the variant of the first embodiment and shows interference between the shield and the straightening vane.

As shown in FIG. 5B, straightening vanes 3C are arranged on the end surface 3A similarly to the straightening vanes 3B described above. However, as shown in FIGS. 6A and 6B, the straightening vanes 3C are removably mounted to the end surface 3A of the diaphragm 3. Each straightening vane 3C is fastened by a bolt B to the end surface 3A of the diaphragm 3. As shown in FIGS. 5 and 6, a sealing body 3D is mounted to a tip of the straightening vane 3C. As shown in FIG. 5B, the sealing body 3D is a ring-like member, and as shown in FIG. 6B, the seal 3D is provided to cover the top ends of the plurality of straightening vanes 3C circumferentially arranged. As shown in FIG. 6A, a width W1 of the sealing body 3D is larger than a width W2 of the straightening vane 3C here, but the width W1 may be equal to the width W2.

On the other hand, as shown in FIG. 5A, an interference maintaining groove 46 provided in the heat shield 11 is continuously formed into a circumferentially annular shape. As shown in FIG. 6B, a width W3 of the interference maintaining groove 46 is set so that the sealing body 3D is inserted into the interference maintaining groove 46 without any substantial gap.

Also in the variant, the respective straightening vanes 3C are inserted into the interference maintaining groove 46. However, in the variant, as shown in FIG. 6B, the sealing body 3D located on the top end side of the straightening vanes 3C is inserted into the interference maintaining groove 46 together with the straightening vane 3C movably in a reciprocating manner.

Also in the variant, the top end side of the straightening vanes 3C is inserted into the interference maintaining groove 46 in the heat shield 11 together with the sealing body 3D. Even if thermal deformation occurs and the straightening vanes 3B are displaced most in the direction X away from the heat shield 11, the top ends of the straightening vanes 3C stay in the interference maintaining groove 46 in the heat shield 11 as shown in FIG. 6B. Thus, since the interference state in which the straightening vanes 3C and the sealing body 3D are inserted into the heat shield 11 is maintained as long as the operation of the centrifugal compressor 1 is continued, the straightening effect of the fluid F by the straightening vanes 3C can be sufficiently obtained. The sealing body 3D prevents the fluid F from entering the interference maintaining groove 46.

Second Embodiment

Next, with reference to FIG. 7, a second embodiment of the present invention will be described.

As with the first embodiment, the second embodiment also proposes a structure in which even if thermal deformation occurs and straightening vanes 3E are displaced in the direction X away from the heat shield 11, an interference state in which top ends of the straightening vanes 3E and the heat shield 11 are in contact is maintained. Now, differences from the first embodiment will be mainly described. In the second embodiment, the straightening vanes 3E are removably secured on the side of the heat shield 11. Thus, the second embodiment is suitably applied to the heat shield 11 having high rigidity.

Figure 7A:
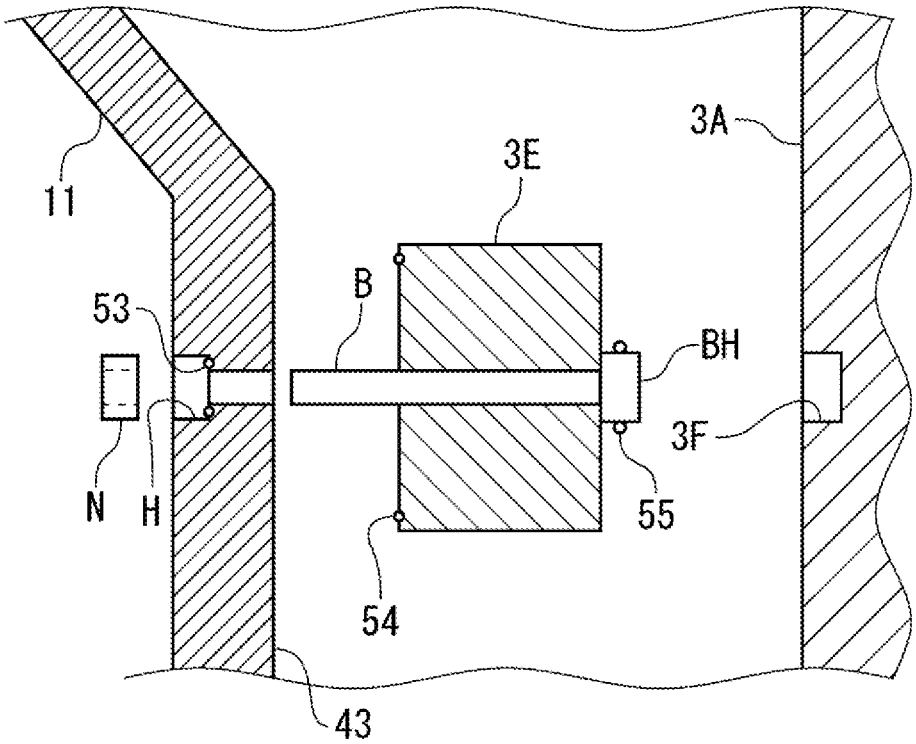
FIG. 7A shows an example of interference between the shield and a straightening vane according to a second embodiment and shows a configuration thereof.
Figure 7B:
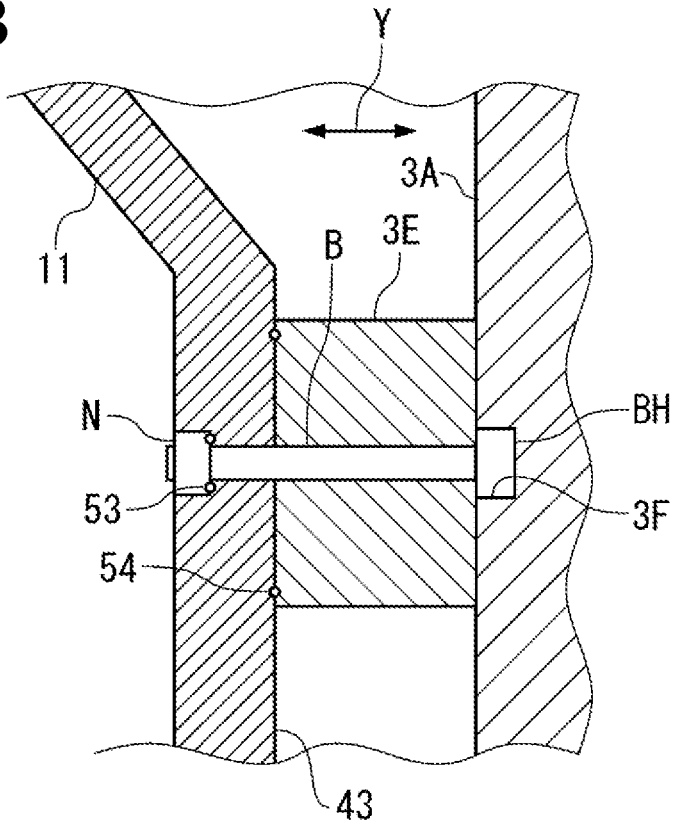
FIG. 7B shows the example of interference between the shield and the straightening vane according to the second embodiment and shows the interference between the shield and the straightening vane.

As shown in FIGS. 7A and 7B, the straightening vane 3E is mounted to the second disk portion 43 of the heat shield 11. Thus, the straightening vane 3E has a through hole H through which a bolt B extends. The through hole H has a small diameter portion through which the bolt B is inserted, and a large diameter portion that holds a nut N engaging the bolt B. The nut N is housed in the large diameter portion of the through hole H, and a top end of the bolt B extending through the straightening vane 3E is fastened by the nut N, thereby securing the straightening vane 3E to the heat shield 11. The end surface 3A of the diaphragm 3 has a bore 3F into which a head of the bolt B is inserted.

Here, a seal material 53 is provided on an uneven portion between the small diameter portion and the large diameter portion of the through hole H, and a seal material 54 is also provided between the heat shield 11 and the straightening vane 3E. The seal materials 53, 54 are made of rubber, resin, or the like, and the seal material 54 is provided along a peripheral edge of the straightening vane 3E.

If the seal material 54 between the heat shield 11 and the straightening vane 3E is elastically deformed by a load applied in an axis direction Y of the bolt B, the straightening vane 3E can be displaced in the axis direction Y. If the seal material 53 in contact with the nut N is elastically deformed by a load applied in the axis direction Y of the bolt B, the bolt B together with the nut N can be displaced in the axis direction. Specifically, when the straightening vane 3E is forced in the axis direction Y of the bolt B, the straightening vane 3E is displaced together with the bolt B and the nut N in the axis direction Y. When the straightening vane 3E is displaced in the axis direction Y, the head BH of the bolt B inserted in the bore 3F slides in the bore 3F in the axis direction Y. To improve airtightness between the bore 3F and the head BH of the bolt B, as shown in FIG. 7A, a seal material 55 may be provided around the head BH. The seal material 55 may be also provided on the top end surface of the head BH.

In the second embodiment, the heat shield 11 having high rigidity is used. Thereby, a configuration can be applied in which while the straightening vane 3E is secured by the bolt B, the seal material 53 is provided between the heat shield 11 and the bolt B and the seal material 54 is provided between the heat shield 11 and the straightening vane 3E. Then, by applying this configuration, the heat shield 11 and the straightening vane 3E are integrally displaced in the axis direction Y.

In the above configuration, even if thermal deformation occurs and the straightening vane 3E is displaced in a direction away from the heat shield 11, since the seal material 53 is provided, it is possible to prevent a gap from being created between the straightening vane 3E and the heat shield 11 in contact with each other via the seal material 53, thereby maintain an interference state. Thus, since the contact state between the straightening vane 3E and the heat shield 11 via the seal material 53 is maintained as long as the operation of the centrifugal compressor 1 is continued, a straightening effect of a fluid F by the straightening vanes 3E can be sufficiently obtained.

Besides the above, the configurations in the above embodiments may be chosen or modified to other configurations without departing from the gist of the present invention.

For example, the configurations of the oil heater 60 and the heat shield 11 are mere examples of the present invention, and any configurations of the oil heater 60 and the heat shield 11 may be adopted as long as an effect of reducing a temperature difference between the inside and outside of the centrifugal compressor can be obtained.

Also, any configuration for maintaining the interference state between the straightening vane and the heat shield may be adopted as long as the straightening effect of the straightening vanes can be ensured. For example, the straightening vanes 3B may be provided on the side of the heat shield 11, and the interference maintaining grooves 45 may be provided on the side of the end surface 3A of the diaphragm 3.

REFERENCE SIGNS LIST

1 Centrifugal compressor
2 Casing
3 Diaphragm
3A End surface
3B Straightening vane(s)
3C Straightening vane(s)
3D Sealing body
3E Straightening vane(s)
3F Bore
4 Suction side casing head
4A Head end surface
5 Discharge side casing head
6 Diaphragm piece(s)
7 Rotor
8 Shaft
9 Impeller(s)
10 Heat insulating space
11 Heat shield
12 Fluid flow path
13 First journal bearing
14 Second journal bearing
15 Thrust bearing
16 Dry gas seal
18 Suction flow path
19 Discharge flow path
20 Internal space
22 Hub
23 Blade(s)
24 Shroud
25 Suction passage
26 Compression passage
27 Diffuser passage
28 Return passage
29 Discharge scroll
30 Seal fin
31 First flat portion
32 First slope portion
33 Second flat portion
34 Second slope portion
40 Securing portion
41 First disk portion
42 First conical portion
43 Second disk portion
44 Second conical portion
45 Interference maintaining groove(s)
46 Interference maintaining groove
49 Heat insulating material
53, 54 Seal material
60 Oil heater
61 Pipe line
62 Oil heater body
63 Heat medium flow path
64 Shield member
B Bolt
C Axis
F Fluid
FE Free end
G Gap
H Through hole(s)
HM Heat medium
L Downstream side
N Nut
U Upstream side

The invention claimed is:

1. A centrifugal compressor comprising:

a rotor including a shaft rotatably supported in a casing and an impeller secured to an outer periphery of the shaft;

a diaphragm surrounding the impeller from an outer peripheral side;

a suction side casing head disposed so as to be spaced apart from the diaphragm on a side where a fluid is suctioned;

a temperature adjusting mechanism that is provided in the suction side casing head and configured to adjust a surrounding temperature by flow of a heat medium;

a heat shield that is provided between the suction side casing head and the diaphragm and defines, together with the impeller, a suction flow path through which the fluid is introduced to the impeller; and a plurality of straightening vanes that are provided in the suction flow path and configured to straighten the fluid flowing through the suction flow path, wherein the heat shield has an annular shape including an outer diameter side and an inner diameter side in a plan view, the inner diameter side of the heat shield is a free end, and a conical portion of the free end extends toward the impeller, and the conical portion is angled non-perpendicularly to an axis line of the shaft, wherein even if the straightening vanes are displaced in a direction away from the heat shield, an interference state between the straightening vanes and the heat shield is maintained.

2. The centrifugal compressor according to claim 1, wherein the plurality of straightening vanes are secured to the diaphragm, and the heat shield includes an interference maintaining groove in which top end sides of the straightening vanes move in a reciprocating manner.

3. The centrifugal compressor according to claim 2, wherein a heat insulating space is provided between the suction side casing head and the heat shield.

4. The centrifugal compressor according to claim 2, wherein the outer diameter side is secured to the suction side casing head.

5. The centrifugal compressor according to claim 2, wherein the plurality of straightening vanes include concave surfaces and convex surfaces facing the concave surfaces, and the plurality of straightening vanes are arranged symmetrically with respect to the fluid flowing through the suction flow path, and the concave surfaces are arranged to face a flow direction of the fluid.

6. The centrifugal compressor according to claim 1, wherein the plurality of straightening vanes are integrally formed with the diaphragm, and the heat shield includes a plurality of interference maintaining grooves in which top end sides of the plurality of straightening vanes move in a reciprocating manner respectively.

7. The centrifugal compressor according to claim 6, wherein the top end sides of the straightening vanes are slidably inserted into the interference maintaining grooves respectively.

8. The centrifugal compressor according to claim 6, wherein a heat insulating space is provided between the suction side casing head and the heat shield.

9. The centrifugal compressor according to claim 6, wherein the outer diameter side is secured to the suction side casing head.

10. The centrifugal compressor according to claim 6, wherein the plurality of straightening vanes include concave surfaces and convex surfaces facing the concave surfaces, and the plurality of straightening vanes are arranged symmetrically with respect to the fluid flowing through the suction flow path, and the concave surfaces are arranged to face a flow direction of the fluid.

11. The centrifugal compressor according to claim 1, wherein the plurality of straightening vanes include a sealing body having an annular shape and circumferentially connecting top ends, the plurality of straightening vanes are removably secured to the diaphragm and the heat shield includes an interference maintaining groove having an annular shape in which the sealing body moves in a reciprocating manner.

12. The centrifugal compressor according to claim 11, wherein the sealing body is slidably inserted into the interference maintaining groove.

13. The centrifugal compressor according to claim 11, wherein the plurality of straightening vanes include concave surfaces and convex surfaces facing the concave surfaces, and the plurality of straightening vanes are arranged symmetrically with respect to the fluid flowing through the suction flow path, and the concave surfaces are arranged to face a flow direction of the fluid.

14. The centrifugal compressor according to claim 1, wherein the plurality of the straightening vanes are secured to the heat shield via a seal material that seals between the straightening vanes and the heat shield.

15. The centrifugal compressor according to claim 14, wherein a heat insulating space is provided between the suction side casing head and the heat shield.

16. The centrifugal compressor according to claim 14, wherein the outer diameter side is secured to the suction side casing head.

17. The centrifugal compressor according to claim 14, wherein the plurality of straightening vanes include concave surfaces and convex surfaces facing the concave surfaces, and the plurality of straightening vanes are arranged symmetrically with respect to the fluid flowing through the suction flow path, and the concave surfaces are arranged to face a flow direction of the fluid.

18. The centrifugal compressor according to claim 1, wherein a heat insulating space is provided between the suction side casing head and the heat shield.

19. The centrifugal compressor according to claim 1, wherein the outer diameter side is secured to the suction side casing head.

20. The centrifugal compressor according to claim 1, wherein the plurality of straightening vanes include concave surfaces and convex surfaces facing the concave surfaces, and the plurality of straightening vanes are arranged symmetrically with respect to the fluid flowing through the suction flow path, and the concave surfaces are arranged to face a flow direction of the fluid.

* * * * *